US007002086B2

(12) United States Patent
Fuji

(10) Patent No.: US 7,002,086 B2
(45) Date of Patent: Feb. 21, 2006

(54) SWITCH DEVICE

(75) Inventor: Tadanari Fuji, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 10/954,372

(22) Filed: Oct. 1, 2004

(65) Prior Publication Data

US 2005/0103609 A1 May 19, 2005

(30) Foreign Application Priority Data

Oct. 3, 2003 (JP) ..... P2003-345883

(51) Int. Cl.
*H01H 13/04* (2006.01)

(52) U.S. Cl. ..... 200/305; 200/296; 200/304; 200/341; 200/343

(58) Field of Classification Search ..... 200/293–296, 200/302.1, 302.2, 304, 305, 341–345
See application file for complete search history.

(56) References Cited

U.S. PATENT DOCUMENTS 5,188,220 A * 2/1993 Schmitt-Walter ..... 200/343
5,664,667 A * 9/1997 Kenmochi ..... 200/305
6,023,033 A * 2/2000 Yagi et al. ..... 200/341
6,392,179 B1 * 5/2002 Schwarzbich ..... 200/341
6,570,111 B1 * 5/2003 Nakagawa et al. ..... 200/343
6,580,043 B1 * 6/2003 Spratte ..... 200/517
6,933,454 B1 * 8/2005 Ishibashi et al. ..... 200/341

FOREIGN PATENT DOCUMENTS

JP UM-A-63-196536 12/1988
JP UM-A-1-167000 11/1989

* cited by examiner

*Primary Examiner*—Michael A. Friedhofer
(74) *Attorney, Agent, or Firm*—Morgan Lewis & Bockius LLP

(57) ABSTRACT

A switch device includes: an operating portion made of a synthetic resin and having a conductive plating layer formed thereon, the operating portion configured to be inserted into a hole formed on a housing of an apparatus; and a shielding portion made of a synthetic resin and having no conducive plating layer formed thereon, the shielding portion formed separately from the operating portion and covers a gap between the operating portion and the hole from an inner side of the housing. The shielding portion is provided to push a tact of a switch provided at a rear side of the shielding portion when the shielding portion is displaced by a pushing operation of the operating portion. The operating portion is fixed to the shielding portion in a state in which the plating layer thereof being not exposed to the rear side of the shielding portion.

5 Claims, 4 Drawing Sheets

SWITCH DEVICE

BACKGROUND OF THE INVENTION

1. Field of the Invention

The present invention relates to a switch device, and particularly, to a switch device in which a conductive plating layer is formed on an operating portion of a push button unit.

2. Description of the Related Art

There is known a switch device in which a switch is combined with a push button unit having an operating portion, and the operating portion of the push button unit is pushed to change a state of the switch. In such a switch device, when a person operates the operating portion of the push button unit, static electricity discharged from the person to the switch may have a bad effect on electrical circuits connected to the switch or damage electronic components. Accordingly, measures intended for preventing the discharge of the static electricity has conventionally been taken.

One of conventional measures for preventing the discharge of static electricity includes employing means in which a flange projecting to the surroundings of the operating portion is integrally molded with a basis of the operating portion as a push button with a synthetic resin, and the flange shields a gap between a hole edge of a hole in a housing and the operating portion inserted into the hole and increases the creeping distance from the operating portion to the switch, which results in improved electrostatic voltage resistance (See. JP-UM-A-1-167000 and JP-UM-A-63-196536).

On the other hand, for electric and electronic apparatuses such as magnetic tape apparatuses using magnetic tapes as recording mediums and optical disk apparatuses using optical disks as recording mediums, it is necessary to form a conductive plating layer such as a metal plating layer on the operating portion that operates the switch.

Further, in a switch device in which a shielding portion projecting to the surroundings of an operating portion is integrally molded with a basis of the operating portion with a synthetic resin, to thereby shield a gap between a hole edge of a hole in a housing and the operating portion inserted into the hole, and a mounting part connected to the shielding portion via a resin hinge is anchored to the housing, it is also necessary to get a pleasing appearance of the operating portion by forming a conductive plating layer at least on the operating portion.

SUMMARY OF THE INVENTION

Under the conditions described above, in order to achieve a satisfactory appearance of the operating portion of the push button unit obtained by integrally molding the operating portion and the shielding portion with a synthetic resin, it is conducive that the conductive plating layer is formed on the entire push button unit.

FIG. 5 is a sectional view of a switch device as a comparative example in which a push button unit and a switch are combined with each other. Here, reference numeral 1 indicates a push button unit and reference numeral 5 indicates a switch.

In the push button unit 1, an operating portion 2 and a shielding portion 3 are integrally molded with each other with a synthetic resin, and a mounting part 32 connected to the shielding portion 3 via a resin hinge 31 is anchored to a housing (not shown) of an electric and electronic apparatus. Considering a case where a conductive plating layer is formed on the entire push button unit 1, the conductive plating layer formed on the shielding portion 3 of the push button unit 1 is disposed close to the switch 5 operated by the push button unit 1. Consequently, the electrostatic voltage resistance may deteriorate extremely. In addition, the push button unit 1 is provided with the resin hinge 31, and a conductive plating layer is also formed on the resin hinge 31. If the resin hinge 31 is repeatedly flexed and deformed, the plating layer formed on the resin hinge 31 may be peeled off, which makes the switch device unsightly, or causes short-circuiting due to the peeled-off and dropped plating layer.

Therefore, in the push button unit obtained by integrally molding the operating portion and the shielding portion with each other, when the conductive plating layer is formed only on the operating portion and the shielding portion is subjected to masking so that a conductive plating layer is not formed thereon, the shielding portion is located between the conductive plating layer of the operating portion and the switch, and the creeping distance between the conductive plating layer and the switch is extended through the shielding portion. Thus, it is regarded that the electrostatic voltage resistance can be improved. Moreover, it is regarded that this configuration avoids a probability that the plating layer on the resin hinge is peeled off.

However, in the push button unit obtained by integrally molding the operating portion and the shielding portion with each other, in a case where a measure is employed in which the shielding portion is subjected to masking in the plating process so that a conductive plating layer is not formed on the shielding portion, it is necessary to connect electrodes for the plating to the operating portion. However, there may be a case that the electrodes cannot be actually connected to the operating portion. For this reason, in the push button unit obtained by integrally molding the operating portion and the shielding portion with each other, it is difficult to employ the measure that a conductive plating layer is formed not on the shielding portion but only on the operating portion.

The present invention has been made under the above situations. It is one of objects of the present invention to provide a switch device in which a push button unit has an operating portion and a shielding portion, and only the operating portion has a conductive plating layer, resulting in a pleasing appearance, and the shielding portion having no conductive plating layer shields a discharge space between a conductive plating layer of the operating portion and the switch and simultaneously extends the creeping distance between the conductive plating layer of the operating portion and the switch, resulting in improved electrostatic voltage resistance.

It is another of objects of the present invention to provide a switch device having an excellent electrostatic voltage resistance, which can also be applied to a case where a mounting part connected to the shielding portion via a resin hinge is anchored to a housing.

According to a first aspect of the invention, there is provided a switch device including: an operating portion made of a synthetic resin and having a conductive plating layer formed thereon, the operating portion configured to be inserted into a hole formed on a housing of an apparatus; and a shielding portion made of a synthetic resin and having no conducive plating layer formed thereon, the shielding portion formed separately from the operating portion and covers a gap between the operating portion and the hole from an inner side of the housing, wherein the shielding portion is provided to push a tact of a switch that is provided at a rear side of the shielding portion when the shielding portion is displaced by a pushing operation of the operating portion, wherein the operating portion is fixed to the shielding portion in a state in which the plating layer thereof being not exposed to the rear side of the shielding portion, wherein the shielding portion has a hole formed thereon, wherein the operating portion has a supporting shaft integrally formed thereon, the supporting shaft having no conductive plating layer formed thereon, wherein the operating portion is fixed to the shielding portion by inserting the supporting shaft into the hole of the shielding portion and welding the supporting shaft to an edge of the hole, and wherein the shielding portion has a ribbed shielding wall integrally formed thereon, the ribbed shielding wall arranged around the tact of the switch.

According to a second aspect of the invention, there is provided a switch device including: an operating portion made of a synthetic resin and having a conductive plating layer formed thereon, the operating portion configured to be inserted into a hole formed on a housing of an apparatus; and a shielding portion made of a synthetic resin and having no conducive plating layer formed thereon, the shielding portion formed separately from the operating portion and covers a gap between the operating portion and the hole from an inner side of the housing, wherein the shielding portion is provided to push a tact of a switch that is provided at a rear side of the shielding portion when the shielding portion is displaced by a pushing operation of the operating portion, and wherein the operating portion is fixed to the shielding portion in a state in which the plating layer thereof being not exposed to the rear side of the shielding portion.

BRIEF DESCRIPTION OF THE DRAWINGS

The above objects and advantages of the present invention will become more apparent by describing a preferred exemplary embodiment thereof in detail with reference to the accompanying drawings, wherein:

FIG. 2B is a schematic rear view thereof;

DETAILED DESCRIPTION OF THE PREFERRED EMBODIMENTS

Referring now to the accompanying drawings, a description will be given in detail of preferred embodiments of the invention.

Figure 1A:
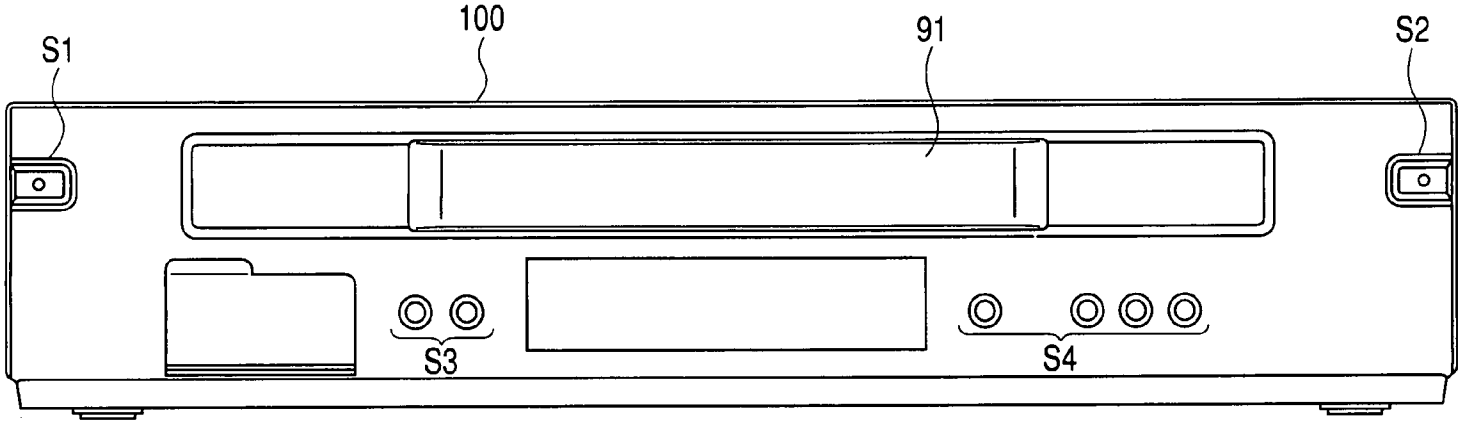
FIG. 1A is a schematic front view of a magnetic tape apparatus comprising an electric and electronic apparatus employing a switch device related to the present invention.
Figure 1B:
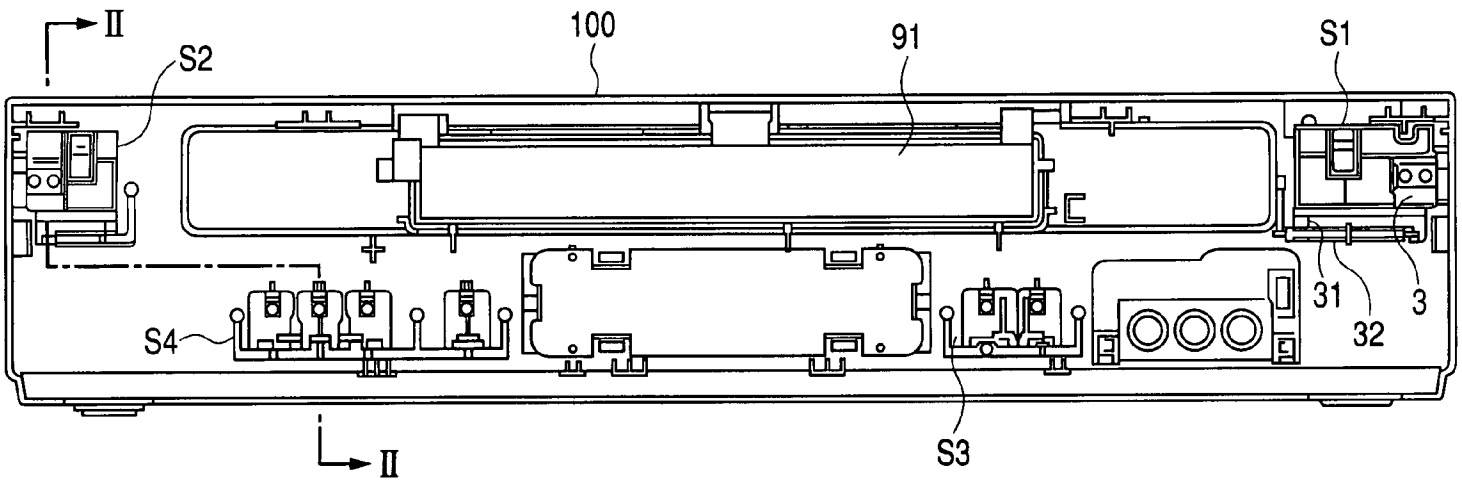

In the magnetic tape apparatus shown in FIGS. 1A and 1B, an oblong tape cassette insertion/ejection port 91 is provided at the upper center of a front panel 110 as a front cover of a housing 100, and a switch device S1 for power supply is at one side of the tape cassette insertion/ejection port 91, and a switch device S2 for stop/ejection is provided at the other side thereof. In addition, an array of buttons of a switch device S3 for channel switching and an array of buttons of a switch device S4 for operation control are arranged below the tape cassette insertion/ejection port 91.

Figure 2:
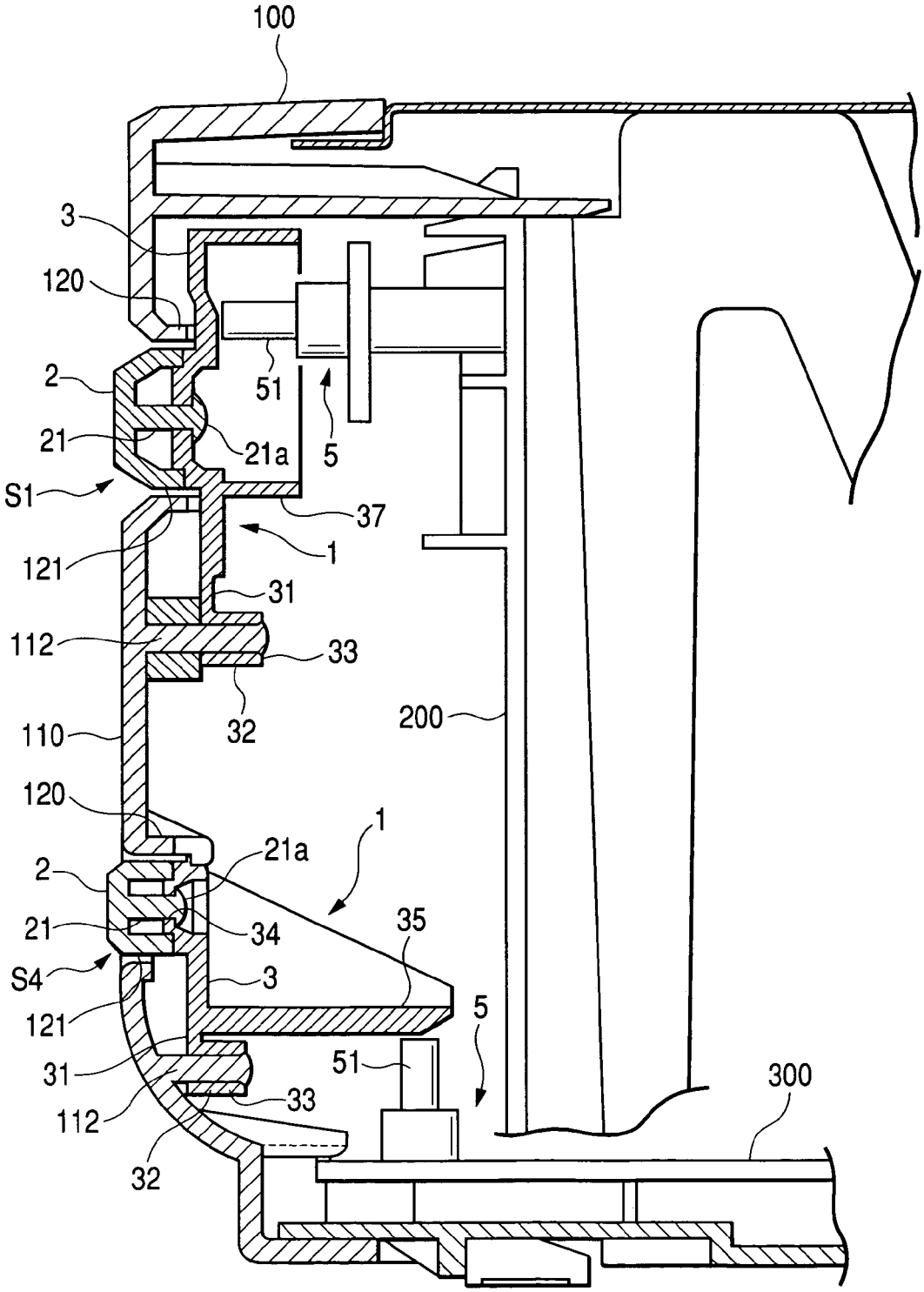
FIG. 2 is an enlarged sectional view of a portion taken along line II—II line shown in FIG. 1B.

As shown in FIG. 2, in the switch device S1 for power supply, the push button unit 1 includes an operating portion 2, which is a plastic resin molding body as a push button, a shielding portion 3 projecting from a base of the operating portion 2 to the surroundings thereof, a thin resin hinge 31 connected to a lower edge of the shielding portion 3, and a mounting part 32 connected to the shielding portion 3 via the resin hinge 31. Also, a plurality of bosses 33 arranged on the mounting part 32 is fitted onto protrusions 112 made of a synthetic resin projecting from the front panel 110 of the housing 100, and then welded to the protrusions 112. Thereby, the push button unit 1 is anchored to the housing 100 and the operating portion 2 is inserted into a hole 120 of the housing 100. In addition, a switch 5 is mounted on a power supply board 200 arranged inside the housing 100, and tact 51 of the switch 5 faces the back of the shielding portion 3. Moreover, the shielding portion 3 has a ribbed shielding wall 37 arranged to cover all around the tact 51 of the switch 5 integrally molded thereto.

In the switch device S1 for power supply, a gap 121 provided between the operating portion 2 of the push button unit land the hole 120 of the housing 100 is covered with the shielding portion 3 from the inside of the front panel 110 of the housing 100. Therefore, when an operator pushes the operating portion 2 with his/her finger, the resin hinge 31 is flexed to displace the shielding portion 3 backward. Accordingly, the shielding portion 3 pushes the tact 51 of the switch 5 to change a state of the switch 5. In addition, when the operating portion 2 is released, the shielding portion 3 and the operating portion 2 return to their initial positions due to the return force of the tact 51 of the switch 5 and the restoring action of the resin hinge 31.

Figure 3:
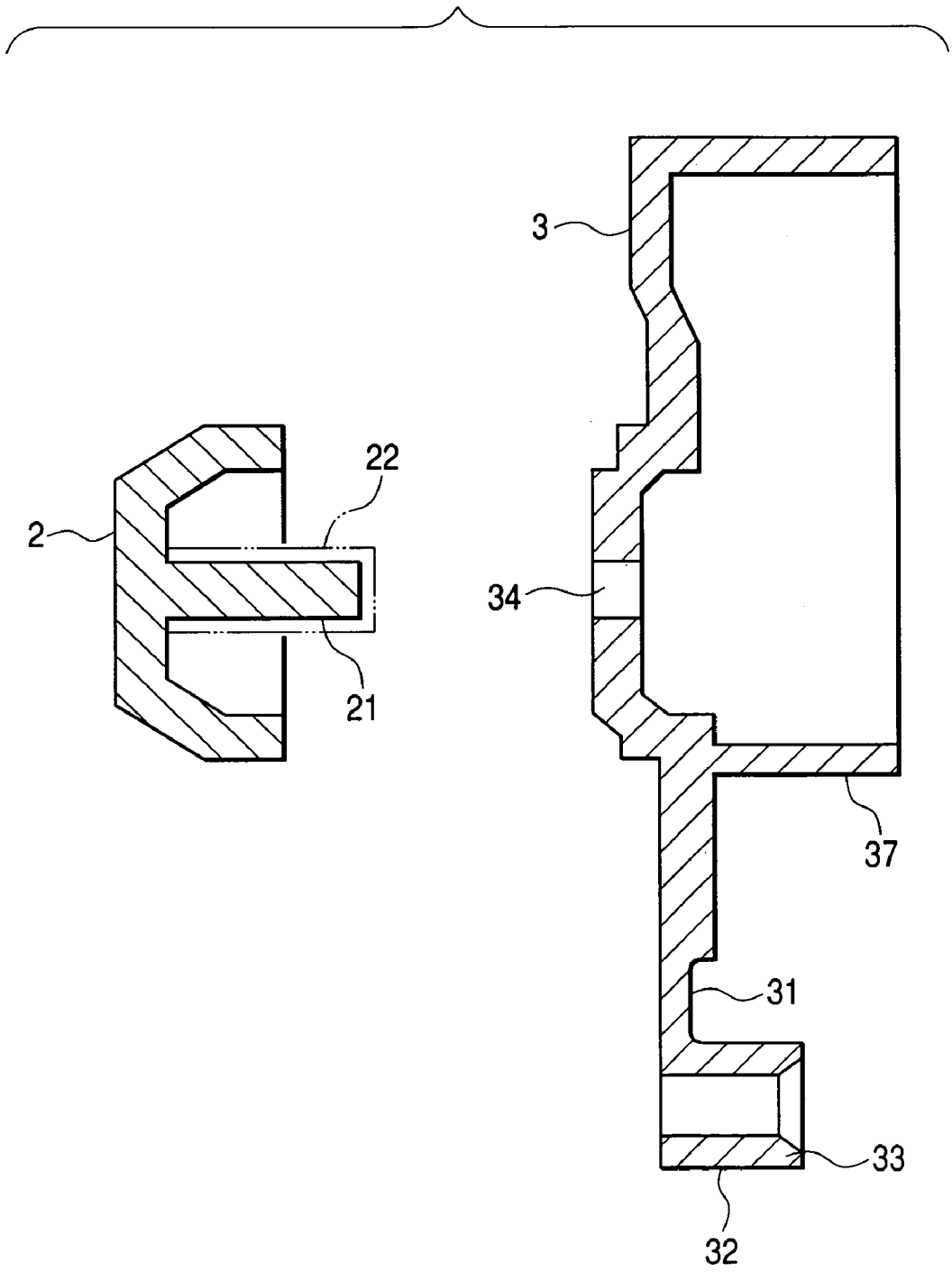
FIG. 3 is an exploded sectional view of a push button unit.

In the switch device of the present embodiment, the push button unit 1 is split into the operating portion 2 and the shielding portion 3, as shown in FIG. 3. Further, a supporting shaft 21 integrally molded with the operating portion 2 is inserted into the hole 34 provided in the shielding portion 3, and the end of the supporting shaft 21 is welded and joined to the shielding portion 3, as shown in FIG. 2. This results in joining the operating portion 2 to the shielding portion 3. In addition, the shielding portion 3, the resin hinge 31 and the mounting part 32 are integrally molded with each other using the plastic resin.

Further, as shown in FIG. 3, in the switch device S1 for power supply, the operating portion 2 and the shielding portion 3 are separately molded with a plastic resin, and are then joined and integrated with each other. Moreover, before the operating portion 2 is joined to the shielding portion 3, the entire supporting shaft 21 is subjected to masking 22, as shown in FIG. 3. In that state, electrodes are connected to the back face of the operating portion 2 to form the conductive plating layer (not shown) on the outer surface of the operating portion 2. After the conductive plating layer is formed, the end of the supporting shaft 21 of the operating portion 2 is inserted into the hole 34 of the shielding portion 3, and is welded and joined to the shielding portion. Therefore, in the push button unit 1 shown in FIG. 2, the operating portion 2 and the shielding portion 3 is integrated with each other. Further, the operating portion 2 has the conductive plating layer, while the supporting shaft 21 of the operating portion 2 and the shielding portion 3 has no conductive plating layer.

Therefore, the push button unit 1 has the operating portion 2 and the shielding portion 3, and only the operating portion 2 has a conductive plating layer, which results in a pleasing appearance. The shielding portion 3 having no conductive plating layer not only shields the discharge space between the conductive plating layer of the operating portion 2 and the switch 5, but also extends the creeping distance between the conductive plating layer of the operating portion 2 and the switch 5, which improves electrostatic voltage resistance. As a result, even if the operating portion 2 is located close to the switch 5, it is rare that electrical circuits or electric and electronic components electrically connected to the switch 5 shall be damaged due to the discharge of static electricity from a person. In particular, in the present embodiment, the ribbed shielding wall 37 provided in the shielding portion 3 surrounds the tact 51 of the switch 5, which further improves the electrostatic voltage resistance.

Furthermore, even when the resin hinge 31 connected to the shielding portion 3 is repeatedly flexed and deformed by the push and return movement of the operating portion 2, the resin hinge 31 does not have the conductive plating layer formed thereon. Accordingly, a situation does not occur that the plating layer is peeled off to cause short-circuiting.

A switch device S4 for control operation shown in FIG. 2 is different from the aforementioned switch device S1 for power supply in that a protrusion piece 35 protrudes rearward from the shielding portion 3 and integrally formed therewith and tact 51 of the switch 5 mounted on a horizontally arranged on a main wiring board 300 faces the back of the protrusion piece 35 from the bottom thereof. Aside from this, the switch device S4 for control operation has the same configuration as that of the switch device S1 for power supply. In other words, the switch device S4 for control operation is the same as the switch device S1 in that the push button unit 1 is split into the operating portion 2 and the shielding portion 3, and the supporting shaft 21 integrally molded with the operating portion 2 is inserted into the hole 34 provided in the shielding portion 3 to weld and join the end of the supporting shaft 21 to the shielding portion 3, which results in joining the operating portion 2 to the shielding portion 3, and in that the operating portion 2 has a conductive plating layer while the supporting shaft 21 of the operating portion 2 and the shielding portion 3 have no conductive plating layer. Therefore, the same reference numerals are given the same or corresponding elements, and description thereof will be omitted to avoid its repetition.

In the switch device S4 for operation control, when an operator pushes the operating portion 2 with his/her finger, the resin hinge 31 is flexed to displace the shielding portion 3 along the protrusion piece 35. Accordingly, the protrusion piece 35 pushes the tact 51 of the switch 5 to change a state of the switch 5. In addition, when a pushing force to the operating portion 2 is released, the shielding portion 3 and the operating portion 3 return to their initial positions due to the return force of the tact 51 of the switch and the restoring action of the resin hinge 31.

In the switch device S4 for operation control, since the push button unit 1 has the operating portion 2 and the shielding portion 3, and only the operating portion 2 has the conductive plating layer, the switch device S4 for operation control shows a pleasing appearance. The shielding portion 3 having no conductive plating layer not only shields the discharge space between the conductive plating layer of the operating portion 2 and the switch 6, but also extends the creeping distance between the conductive plating layer of the operating portion 2 and the switch 6, which results in improved electrostatic voltage resistance. In addition, when the resin hinge 31 is repeatedly flexed and deformed by the push and return movement of the operating portion 2, there is no probability of causing short-circuiting by the plating layer being peeled off because the resin hinge 31 has no conductive plating layer formed thereon.

Further, a switch device S2 for stop/ejection shown in FIGS. 1A and 1B has the same configuration as the switch device S1 for power supply, and the switch device S3 for channel switching has the same configuration as the switch device S4 for operation control.

In the switch device S1 for power supply and the switch device S4 for operation control, which have been described referring to FIG. 2, a discharge path between the conductive plating layer and the switch 5 is shielded by the shielding portion 3 disposed in a facing space between the switch 5 and the conductive plating layer applied on the operating portion 2 of the push button unit 1. Moreover, since the creeping distance between those two are extended, and the supporting shaft 21 of the operating portion 2 has no conductive plating layer formed thereon, even when the operating portion 2 having the conductive plating layer is disposed close to the switch 5, the excellent electrostatic voltage resistance is achieved.

Meanwhile, the inventor of the present application conducted researches on the electrostatic voltage resistance in a case where a conductive plating layer is formed on the entire operating portion 2 including the supporting shaft 21 without forming the masking 22 of the supporting shaft 21 of the operating portion 2 illustrated in FIG. 3, the supporting shaft 21 is inserted into the hole 34 of the shielding portion 3 and is welded and joined to the shielding portion. At this time, at the end of the supporting shaft 21 heated and crushed, a part of the conductive plating layer of the supporting shaft 21 is embedded in a resin layer. From the result of the researches, it was found that, in a case where a heated and crushed portion 21*a* of the supporting shaft 21 is relatively separated from the switch 5 as in the switch device S4 for operation control, when an operator operates the operating portion 2 with his/her finger, a situation does not occur that static electricity shall be discharged from the operator to the switch 5. However, it was found that, in a case where the heated and crushed portion 21*a* of the supporting shaft 21 is disposed close to the switch 5 as in the switch device S1 for power supply shown in FIG. 2, when an operator pushes the operating portion 2 with his/her finger, static electricity may be discharged from the operator to the switch 5.

From the foregoing, it is found that, in a case where the supporting shaft 21 has the conductive plating layer as described above, even when the operating portion 2 and the switch 5 is disposed close to each other, static electricity is not discharged. This shall be result in a small-sized switch device.

Figure 4:
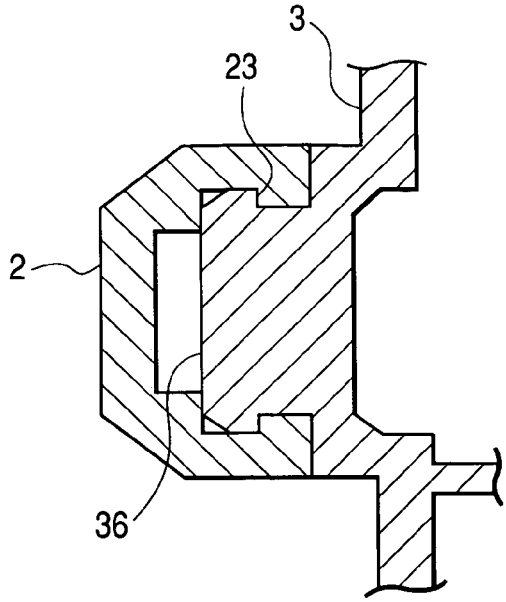
FIG. 4 is sectional view of essential parts of a push button unit according to a modification.
Figure 5:
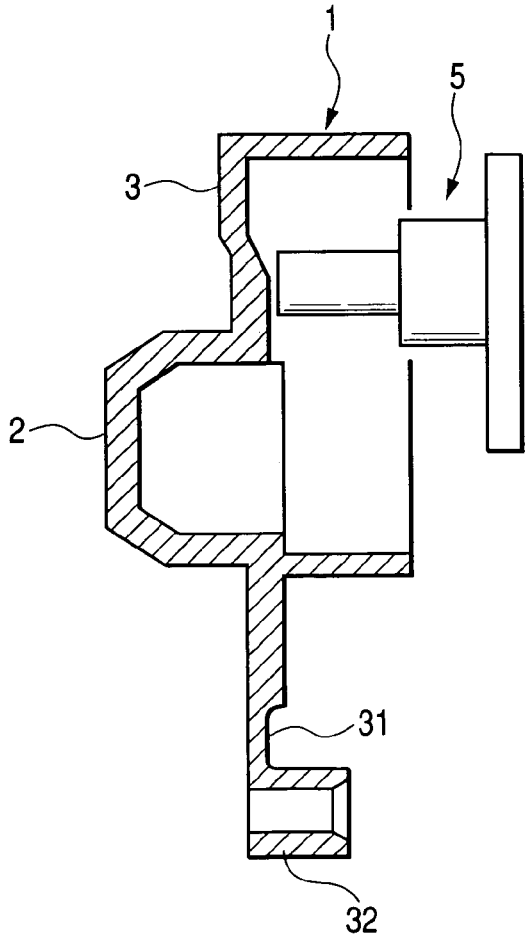
FIG. 5 is a sectional view of a switch device as a comparative example in which a push button unit and a switch are combined with each other.

FIG. 4 illustrates a modification of a joining mechanism by which the split operating portion 2 and shielding portion 3 are joined to each other. In this instance, a shielding portion 3 is integrally formed with a latching part 36 that is a forward protruding protrusion with claws, and a latched part 23 of the operating portion 2 having a conductive plating layer formed thereon is fitted and latched to the latching part 36. In this structure, since the conductive plating layer is not exposed to the back of the shielding portion 3. Thus, excellent electrostatic voltage resistance can be obtained.

Although the above-described embodiments have been described in connection with the switch device applied to a magnetic tape apparatus, the switch device can also be applied to other electric and electronic apparatuses such as recording/reproducing apparatuses using disks.

According to the present invention, there is provided a switch device having a push button unit, the push button unit including: an operating portion made of a synthetic resin and inserted into a hole of a housing; and a shielding portion made of a synthetic resin for covering a gap between the operating portion and a the hole from the inner side of the housing. The shielding portion accompanying pushing operation of the operating portion of the push button unit is displaced to push tact of a switch disposed at the rear side of the shielding portion. The push button unit is split into the shielding portion having no conductive plating layer and the operating portion having the conductive plating layer, and the operating portion is joined to the shielding portion in a state in which the plating layer thereof is not exposed to the back of the shielding portion.

According to the above configuration, the operating portion of the push button unit is split from the shielding portion, and the operating portion is then joined to the shielding portion. Therefore, before joining the operating portion and the shielding portion to each other, it is possible to perform a plating process only on the operating portion. For this reason, it is convenient that it is possible to form a push button unit by connecting electrodes for the plating process to the operating portion to form a conductive plating layer on the operating portion, and after the plating process, to join the operating portion to the shielding portion to form the push button unit. In addition, according to the aforementioned switch device having the above configuration, not only the operating portion shows a pleasing appearance because the operating portion has a conductive plating layer, but also the electrostatic voltage resistance is improved because the shielding portion having no conductive plating layer is disposed in a space between the switch and the operating portion having the conductive plating layer, and the shielding portion shields a gap between the operating portion and a hole edge of a hole in a housing while extending the creeping distance from the conductive plating layer on the operating portion and the switch. Hence, even when a person operates the operating portion, it is rare that static electricity shall be discharged from the person to the switch.

In the present invention, it is possible to employ a configuration in which the operating portion is joined to the shielding portion by inserting a supporting shaft made of a synthetic resin with no conductive plating layer and integrally molded with the operating portion, into the hole provided in the shielding portion, and welding and joining the supporting shaft to the hole. According to this configuration, even if the supporting shaft is pushed into the hole edge of the shielding portion and is welded and joined to the shielding portion so that the supporting shaft is disposed close to the switch, the electrostatic voltage resistance does not deteriorate because the supporting shaft has no conductive plating layer formed thereon. Accordingly, with this configuration, the electrostatic voltage resistance is also improved and, even when a person operates the operating portion, it is rare that static electricity shall be discharged from the person to the switch.

In the present invention, it is possible to employ a configuration in which the operating portion is joined to the shielding portion by latching a latched part provided in the operating portion to the front side of a latching part provided in the shielding portion. According to this configuration, the operating portion can be joined to the shielding portion without performing a welding process. This not only improves the assembling property of the switch device, but also enhances the electrostatic voltage resistance because the shielding portion is disposed in a facing space between the conductive plating layer of the operating portion and the switch and the shielding portion shields a gap between the operating portion and the hole in the housing while extending the creeping distance between the conductive plating layer on the operating portion and the switch. Besides, even when a person operates the operating portion, it is rare that static electricity shall be discharged from the person to the switch.

According to the present invention, it is desirable that a ribbed shielding wall arranged around the tact of the switch for increasing creeping distance from the operating portion to the tact be integrally molded with the shielding portion. According to the above configuration, since the shielding wall surrounds the switch tact, the creeping distance between the conductive plating layer on the operating portion and the switch can be further extended to further improve the electrostatic voltage resistance.

The switch device related to the present invention is further implemented by employing a configuration in which a switch device having a push button unit, the push button unit comprising: an operating portion made of a synthetic resin and inserted into a hole of a housing; and a shielding portion made of a synthetic resin for covering a gap between the operating portion and a the hole from the inner side of the housing, in which the shielding portion accompanying pushing operation of the operating portion of the push button unit is displaced to push tact of a switch disposed at the rear side of the shielding portion, in which the push button unit is split into the shielding portion having no conductive plating layer and the operating portion having the conductive plating layer, and the operating portion is joined to the shielding portion by inserting a supporting shaft made of a synthetic resin with no conductive plating layer and integrally molded with the operating portion, into the hole provided in the shielding portion, and welding and joining the supporting shaft to the hole, and in which a ribbed shielding wall arranged around the tact of the switch for increasing creeping distance from the operating portion to the tact is integrally molded into the shielding portion, and a mounting part connected to the shielding portion via a resin hinge is anchored to the housing. Advantages of the present invention will now be described in more detail with reference to the embodiments as described below.

According to the present invention, the push button unit has the operating portion and the shielding portion, and only the operating portion has a conductive plating layer, which results in a pleasing appearance. The shielding portion having no conductive plating layer not only shields the discharge space between the conductive plating layer of the operating portion and the switch, but also extends the creeping distance between the conductive plating layer of the operating portion and the switch, which results in improved the electrostatic voltage resistance. For this reason, even in a switch device where the switch is disposed relatively close to the operating portion of the push button unit, the switch device has a pleasing appearance by the virtue of the conductive plating layer on the operating portion. Moreover, it is rare that static electricity shall be discharged from a person to electrical circuits or electric and electronic components, which are electrically connected to the switch. This shall result in a small-sized switch device, and a small-sized electronic apparatus having an excellent switch device.

Further, according to the present invention, even in a device on which a mounting part connected to the shielding portion of the push button unit via the resin hinge is anchored to the housing, the resin hinge does not have a plating layer formed thereon. Therefore, even when the resin hinge is repeatedly flexed and deformed by the operation of a push button, there is no probability that the plating layer is peeled off. Accordingly, there is no probability of causing short-circuiting by the plating layer being peeled off.

From the foregoing, in a switch device on which the mounting part connected to the shielding portion of the push button unit via the resin hinge is anchored to the casing, although the switch device comprises the operating portion showing a pleasing appearance by virtue of the conductive plating layer thereon, it has excellent electrostatic voltage resistance, it is rare that electrical circuits or electronic components shall be damaged due to static electricity. Moreover, a small-sized switch device can be provided.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A switch device comprising:

an operating portion made of a synthetic resin and having a conductive plating layer formed thereon, the operating portion configured to be inserted into a hole formed on a housing of an apparatus; and a shielding portion made of a synthetic resin and having no conducive plating layer formed thereon, the shielding portion formed separately from the operating portion and covers a gap between the operating portion and the hole from an inner side of the housing, wherein the shielding portion is provided to push a tact of a switch that is provided at a rear side of the shielding portion when the shielding portion is displaced by a pushing operation of the operating portion, wherein the operating portion is fixed to the shielding portion in a state in which the plating layer thereof being not exposed to the rear side of the shielding portion, wherein the shielding portion has a hole formed thereon, wherein the operating portion has a supporting shaft integrally formed thereon, the supporting shaft having no conductive plating layer formed thereon, wherein the operating portion is fixed to the shielding portion by inserting the supporting shaft into the hole of the shielding portion and welding the supporting shaft to an edge of the hole, and wherein the shielding portion has a ribbed shielding wall integrally formed thereon, the ribbed shielding wall arranged around the tact of the switch.

2. A switch device comprising:

an operating portion made of a synthetic resin and having a conductive plating layer formed thereon, the operating portion configured to be inserted into a hole formed on a housing of an apparatus; and a shielding portion made of a synthetic resin and having no conducive plating layer formed thereon, the shielding portion formed separately from the operating portion and covers a gap between the operating portion and the hole from an inner side of the housing, wherein the shielding portion is provided to push a tact of a switch that is provided at a rear side of the shielding portion when the shielding portion is displaced by a pushing operation of the operating portion, and wherein the operating portion is fixed to the shielding portion in a state in which the plating layer thereof being not exposed to the rear side of the shielding portion.

3. The switch device according to claim 2, wherein the shielding portion has a hole formed thereon, wherein the operating portion has a supporting shaft integrally formed thereon, the supporting shaft having no conductive plating layer formed thereon, and wherein the operating portion is fixed to the shielding portion by inserting the supporting shaft into the hole of the shielding portion and welding the supporting shaft to an edge of the hole.

4. The switch device according to claim 2, wherein the shielding portion has a latching part provided thereon, wherein the operating portion has a latched part provided thereon, and wherein the operating portion is fixed to the shielding portion by latching the latched part to the latching part.

5. The switch device according to claim 2, wherein the shielding portion has a ribbed shielding wall integrally formed thereon, the ribbed shielding wall arranged around the tact of the switch.

* * * * *